US007524110B2

(12) United States Patent
Anzini et al.

(10) Patent No.: US 7,524,110 B2
(45) Date of Patent: Apr. 28, 2009

(54) RECLOSABLE PACKAGE WITH SLIDER ZIPPER SHIELDED FOR HIGH PRESSURE PASTEURIZATION

(75) Inventors: David J. Anzini, Farmington, NY (US); Steven Ausnit, New York, NY (US); Michael J. Lasofsky, Pomona, NY (US); Lars Wihlborg, Stratford, CT (US); Per Bentsen, Suffern, NY (US); Robert G. Kobetsky, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 658 days.

(21) Appl. No.: 11/103,751

(22) Filed: Apr. 12, 2005

(65) Prior Publication Data

US 2006/0228054 A1 Oct. 12, 2006

(51) Int. Cl.
*B65D 33/14* (2006.01)
*B65D 33/16* (2006.01)
*B65D 33/00* (2006.01)

(52) U.S. Cl. ..... 383/5; 383/61.2; 383/64; 383/204

(58) Field of Classification Search ..... 383/61.2, 383/204, 64, 5, 203
See application file for complete search history.

(56) References Cited

U.S. PATENT DOCUMENTS 5,283,932 A * 2/1994 Richardson et al. ..... 24/400
6,138,439 A 10/2000 McMahon et al.
6,488,410 B2 * 12/2002 Schneider ..... 383/5
6,575,625 B2 * 6/2003 Cappel et al. ..... 383/5
6,799,890 B2 * 10/2004 Schneider et al. ..... 383/210
7,223,222 B2 * 5/2007 Anzini et al. ..... 493/214
7,246,944 B2 * 7/2007 Bois ..... 383/5
2001/0043762 A1 11/2001 Cappel et al.
2003/0044093 A1 * 3/2003 Schneider et al. ..... 383/5
2003/0185945 A1 * 10/2003 Buchman ..... 426/122
2005/0160566 A1 * 7/2005 Chang ..... 24/427

FOREIGN PATENT DOCUMENTS

EP 1 291 286 A 3/2003
JP 11180452 A 7/1999

OTHER PUBLICATIONS

U.S. Appl. No. 11/020,607, filed Dec. 23, 2004.

* cited by examiner

*Primary Examiner*—Jes F Pascua
(74) *Attorney, Agent, or Firm*—Day Pitney LLP

(57) ABSTRACT

The disclosure relates to a semi-soft cap or patch which is secured by adhesive to a slider on a zipper in a reclosable package. This cap or patch prevents the slider from puncturing the web or film of the bag during high pressure pasteurization. Further, the cap or patch is secured to a tear-away header which is formed as a shroud over the zipper. This allows the user to tear off the header which likewise removes the cap or patch from the slider. The header, with the cap or patch still attached thereto, can thereafter be disposed of as a single piece.

10 Claims, 2 Drawing Sheets

RECLOSABLE PACKAGE WITH SLIDER ZIPPER SHIELDED FOR HIGH PRESSURE PASTEURIZATION

BACKGROUND OF THE INVENTION

1. Field of the Invention

The present invention relates to a reclosable package with a slider zipper which is shielded by a semi-soft cap or patch for high pressure pasteurization. Similarly, the present invention relates to a method for removal of the semi-soft cap or patch after high pressure pasteurization.

2. Description of the Prior Art

High pressure pasteurization (HPP) of food-containing packages is accomplished by placing the packages in a chamber that is typically raised to 85,000 psi for a set time period. Typical reclosable food packages with a sliderless or "press-to-close" zipper will survive high pressure pasteurization. However, packages with slider zippers have, in the past, proven to be problematic. The zippers are typically enclosed in the packaging by the top portion of the packaging film, such as a shroud. During the high pressure pasteurization process, the extreme pressure pushes the shroud film onto the slider with such force as to punch holes in the film, rendering the package useless.

Commonly assigned U.S. patent application Ser. No. 11/020,607 entitled "Sleeve Cover for Slider", filed on Dec. 23, 2004, the contents of which are hereby incorporated by reference, discloses a semi-soft sleeve cover to shield the slider during high pressure pasteurization. While this has been satisfactory for its intended purposes, further improvements are sought in the assembly of the small parts during the package forming process. In particular, the caps must be fit into the slider clips with a degree of precision to ensure that the entire slider is covered prior to high pressure pasteurization. Otherwise, the potential exists for the soft caps to come loose during the package forming process, rendering the final package useless. Additionally, the removal of the cap or patch, either as part of the manufacturing process or by the consumer, is an area in which improvements are sought.

OBJECTS AND SUMMARY OF THE INVENTION

It is therefore an object of the present invention to improve the protection of the film of a reclosable plastic bag, particularly a shrouded bag with a slider zipper, during high pressure pasteurization.

It is therefore a further object of the present invention to improve the reliability of the assembly and placement of protective caps or similar structures over the sliders of a slider zipper of a reclosable bag which is undergoing high pressure pasteurization.

It is therefore a still further object of the present invention to provide a method to remove the cap or patch from the slider after high pressure pasteurization and prior to the consumer opening the bag.

These and other objects are attained by providing a semi-soft cap or patch that is large enough to totally envelope the slider in the package. The cap or patch is secured to the film in the package, such as the shroud, assuring that it will remain in a position where it can protect the slider and film during the HPP process. Additionally, in the case of a tear-away header, the cap or patch is tack sealed to the header so that the removal of the header by the consumer, well after the high pressure pasteurization is completed, results in the removal of the cap or patch along with the header as a single piece which facilitates simple disposal by the consumer.

Further advantages are achieved by a semi-soft patch in this regard as the assembly of the final package is simplified, the hazards of small plastic parts coming loose are minimized or eliminated and the semi-soft patch can be economically produced by standard extrusion techniques.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
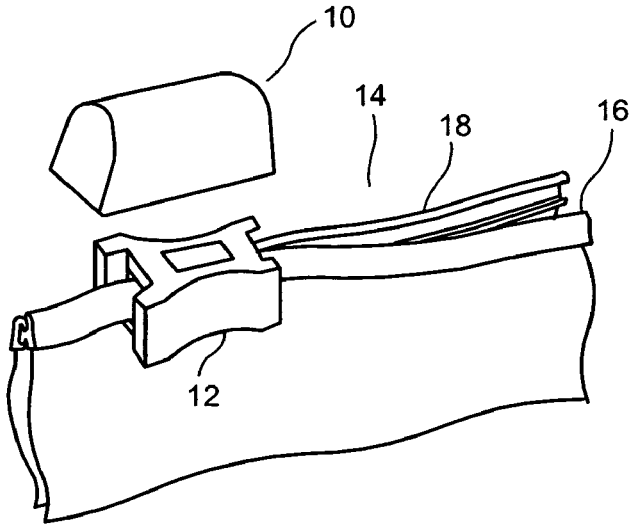
FIG. 1 is an exploded perspective view of the soft or semi-soft cap or patch fitting over the slider of the reclosable bag in the present invention.
Figure 3:
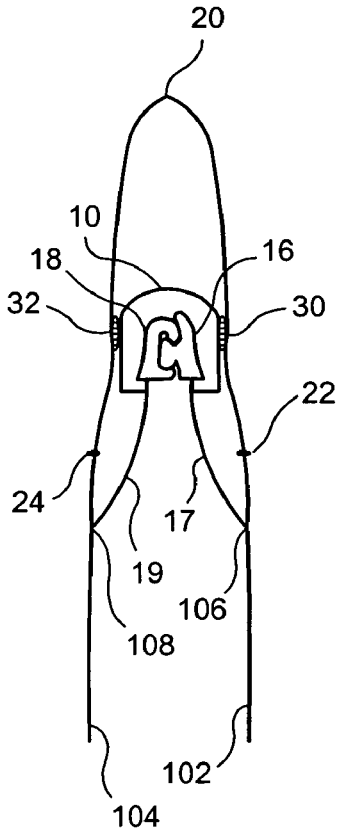
FIG. 3 is a cross-sectional view along plane 3-3 of FIG. 2.

Referring now to the drawings in detail wherein like numerals indicate like elements throughout the several views, one sees that FIG. 1 is an exploded view of soft or semi-soft cap or patch 10 being inserted over slider 12 of zipper 14, which includes first and second interlocking profiles 16, 18 with respective first and second flanges 17, 19 (see FIG. 3). Soft or semi-soft cap 10 can be similar to the silicone cap disclosed in commonly owned U.S. patent application Ser. No. 11/020,607 entitled "Sleeve Cover for Slider", filed on Dec. 23, 2004, the contents of which are hereby incorporated by reference. Additionally, cap 10 can be a semi-soft patch comprising one or more of foamed polymeric materials, elastomeric sheet materials, tape, or polymer films with a thickness greater than that of the film forming the reclosable bag.

The patch 10 is typically of a size that allows the patch material to extend fully beyond the edges of the slider 12 when the package is formed, which will ensure that all edges of slider 12 are protected.

Figure 2:
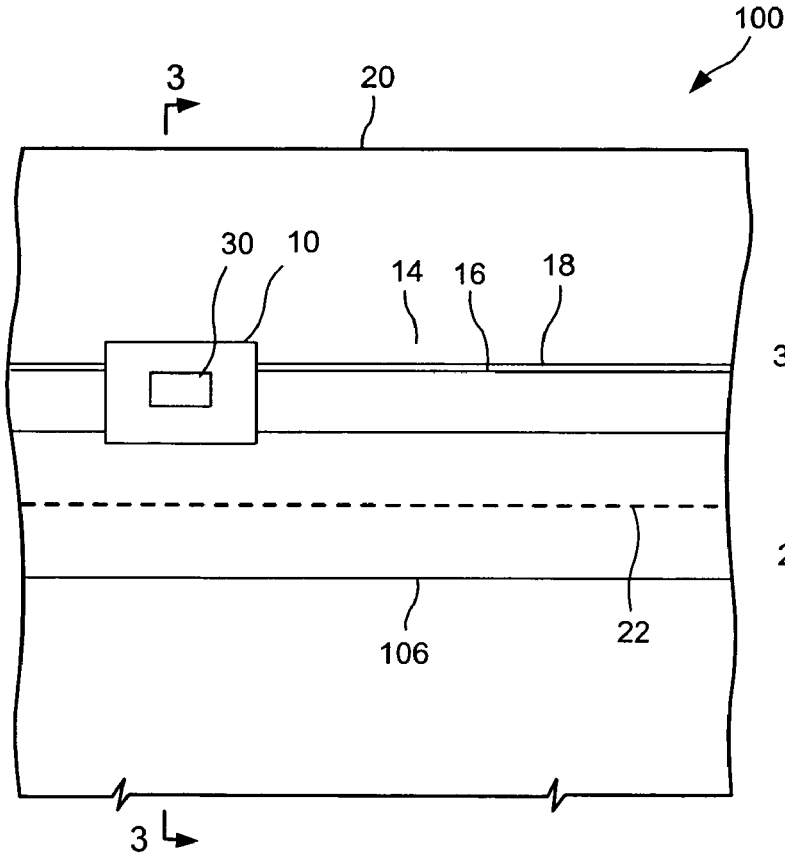
FIG. 2 is a plan view showing the tack seal between the soft or semi-soft cap or patch and the shroud of the recloseable bag in the present invention.

As shown in FIG. 2, cap or patch 10 is particularly well adapted for use with a reclosable bag 100 formed from first and second walls of web 102, 104 and which includes shroud 20 (or tear-away header) formed over zipper 14. As shown in FIG. 3, first and second walls of web 102, 104 and shroud 20 can be formed from a single sheet of folded web. First and second flanges 17, 19 are sealed to respective first and second walls 102, 104 along respective seal lines 106, 108. The shroud 20 further includes lines of weakness 22, 24 (see FIG. 3) formed above seal lines 106, 108. Lines of weakness 22, 24 allow shroud 20 to be tom away from reclosable bag 100 in a tamper-evident manner to allow access to the zipper 14 by the user (see FIG. 4).

Reclosable bags with shrouds formed over the zippers are known in the prior art, such as U.S. Pat. No. 6,799,890 entitled "Tamper Evident Resealable Packaging", issued on Oct. 5, 2004 to Schneider et al. Similarly, shrouds can be formed by a "zipper-in-the-fold" configuration as is disclosed in U.S. Pat. No. 6,138,439 entitled "Methods of Making Slide-Zippered Reclosable Packages on Horizontal Form-Fill-Seal Machines", issued on Oct. 31, 2000 to McMahon et al.

Figure 4:
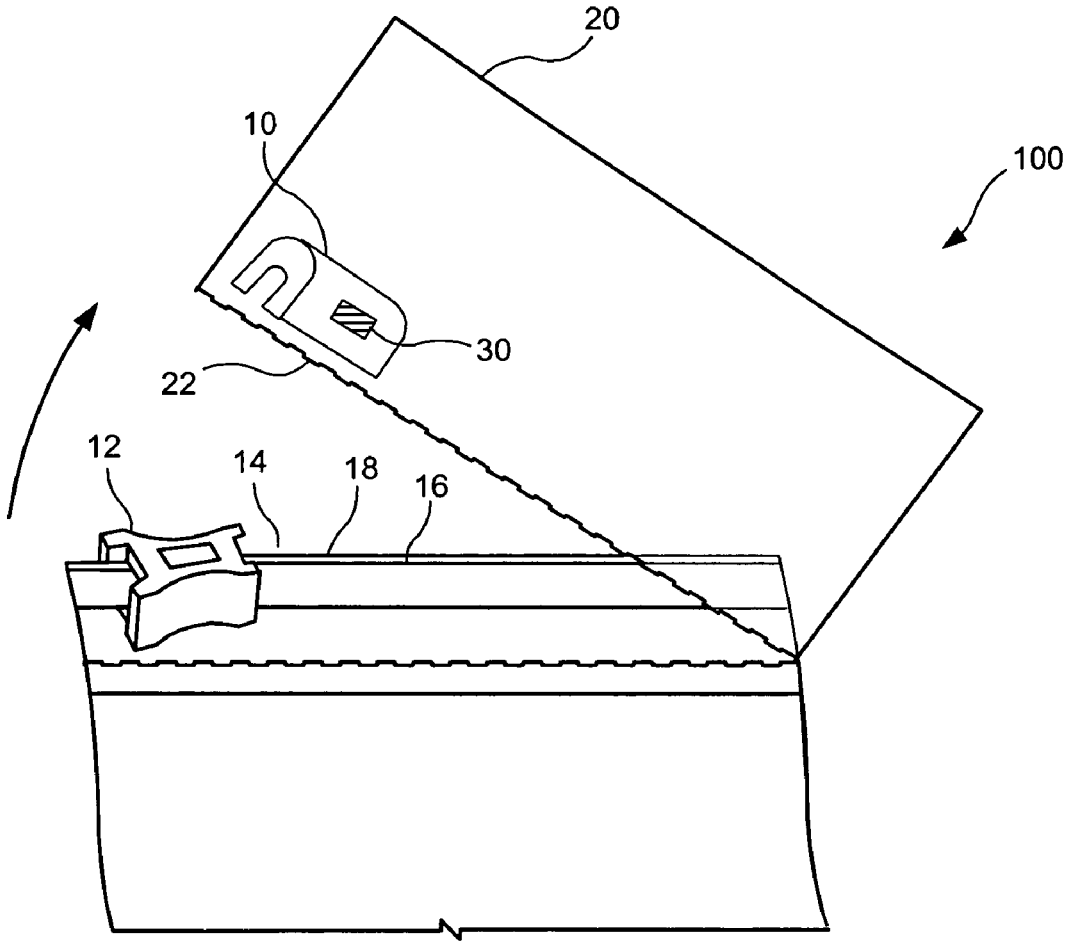
FIG. 4 is a plan view illustrating the shroud along with soft or semi-soft cap or patch being removed from the reclosable bag in the present invention.

Tack seals 30, 32 are formed (typically thermally or ultrasonically) between the cap or patch 10 and opposite walls of shroud 20. This secures cap or patch 10 in place as shown in FIG. 2 and further secures cap or patch 10 to shroud 20 in the torn away position shown in FIG. 4. Alternately, adhesive which is sufficiently strong to maintain a connection with the shroud 20 during removal of the shroud 20 as shown in FIG. 4 may be used in place of tack seals 30, 32.

Additionally, patch 10 typically includes an adhesive on the interior thereof to secure patch 10 to slider 12. This adhesive should be sufficiently weak in order to allow the patch or cap 10 to be detached from slider 12 during removal of the shroud 20 as shown in FIG. 4.

After the reclosable bag 100, manufactured in accordance with the above description, has been successfully processed by high pressure pasteurization, it is envisioned that the reclosable bag 100, with the cap or patch 10 in place, will be sold to end users. When the end user opens the reclosable bag 100 by tearing off the shroud 20, the cap or patch 10 will remain secured to the shroud 20 as shown in FIG. 4 and thus come off of the slider 12 with the shroud 20. This allows for the simple disposal of the entire shroud/soft cap assembly and will ensure that the soft cap or patch will not be loose as a single small piece.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable bag, comprising:

first and second walls of web;

a zipper including first and second interlocking profiles attached to respective said first and second walls of web, said zipper further including a slider;

a shroud formed over said zipper, the shroud including lines of weakness;

a patch or cap attached to said slider, said patch or cap being secured to said shroud more strongly than said patch or cap is attached to said slider whereby said shroud can be torn from said bag along said lines of weakness, said patch or cap remaining secured to said shroud after said shroud is removed from said bag.

2. The reclosable bag of claim 1, wherein said patch or cap is secured to said shroud by tack seals.

3. The reclosable bag of claim 2 wherein said tack seals are formed thermally.

4. The reclosable bag of claim 2 wherein said tack seals are formed ultrasonically.

5. The reclosable bag of claim 1, wherein an interior of said cap or patch is attached to said slider by an adhesive.

6. The reclosable bag of claim 5 wherein said adhesive is of sufficient weakness that said patch or cap separates from said slider when said shroud is removed from said bag.

7. The reclosable bag of claim 1, wherein said patch or cap is formed from the group consisting of silicone, foamed polymeric materials, elastomeric sheet materials, tape and polymer films.

8. The reclosable bag of claim 1, wherein said first and second interlocking profiles include respective first and second flanges which are sealed to respective said first and second walls by respective first and second seal lines below said lines of weakness.

9. The reclosable bag of claim 1, wherein said bag is adapted to be subjected to high pressure pasteurization.

10. The reclosable bag of claim 1 wherein said first and second walls of web and said shroud are formed from a single sheet of web.

* * * * *